United States Patent [19]

Szadkowski

[11] 4,220,270

[45] Sep. 2, 1980

[54] FLOW CONTROL DEVICE FOR MOLTEN METAL

[75] Inventor: Stanislav Szadkowski, Brussels, Belgium

[73] Assignee: Vesuvius International Corporation, Wilmington, Del.

[21] Appl. No.: 20,397

[22] Filed: Mar. 14, 1979

[30] Foreign Application Priority Data

Mar. 21, 1978 [GB] United Kingdom ..... 11180/78

[51] Int. Cl.[2] ..... B22D 41/10

[52] U.S. Cl. ..... 222/600; 137/867; 137/874; 222/504; 251/294; 251/249.5

[58] Field of Search ..... 137/867, 874; 251/249.5, 294; 222/600, 504, 512, 505

[56] References Cited

U.S. PATENT DOCUMENTS 1,829,182 10/1931 Beaumont ..... 222/504

3,618,834 11/1971 Shapland et al. ..... 222/600

3,730,401 5/1973 Bode, Jr. ..... 222/600 X

*Primary Examiner*—David A. Scherbel

*Attorney, Agent, or Firm*—Sughrue, Rothwell, Mion, Zinn and Macpeak

[57] ABSTRACT

The invention provides a slide gate device for use on a pour vessel to control flow of molten metal through an outlet in the vessel shell, in which refractory insert plates, conveyed by supporting frames, are introducible into and removable from at least one side of the device, and in which said refractory insert plates are linearly movable in continuous close cooperating contact with a perforated outlet plate for the pour vessel, by applying interdependently coupled moving means to the supporting frame(s) conveying said refractory insert plates, which means transmit an equally distributed effort to each lateral side of said supporting frame(s).

10 Claims, 7 Drawing Figures

FLOW CONTROL DEVICE FOR MOLTEN METAL

SUBJECT MATTER OF THE INVENTION

This invention relates to a slide gate device for controlling flow of molten metal from a vessel containing such molten metal, herein further referred to as a "pour vessel".

More particularly it relates to an improved device in which a refractory plate having an aperture may be linearly moved in front of a refractory plate positioned to the pour vessel outlet, in a plane perpendicular to the axis of the outlet, whereby there is always provided a close cooperating contact between the outlet refractory plate and said moving refractory plate.

THE PRIOR ART

Slide gate devices for use on pour vessels for molten metal, in which a refractory plate, having an aperture is linearly movable in a plane which is perpendicular to the axis of the outlet in the vessel shell, whereby said aperture may be brought in alignment with the outlet in the vessel shell, are already known in the art of casting metals.

In these known devices the movement of the refractory plates is in general achieved by means of, for instance, hydraulic pushing and drawing levers, acting on a supporting frame of said refractory plate. Such known slide gate mechanisms do however show a number of drawbacks in their practical use, such as a serious restriction with respect to the moving range of the refractory plate, owing to the stroke limitation of the lever system itself, a rather uneasy mounting and replacement of the refractory plates, owing to the presence of such levers, and an inherrent unstable situation of the forces equilibrum owing to the concentration of the pushing forces of such levers on a limited portion of the supporting frame.

BRIEF DESCRIPTION OF THE INVENTION

It is an object of the present invention to provide an improved slide gate device for use on a pour vessel for controlling the flow of molten metal, which avoids the above drawbacks of the known devices, by always providing an equally distributed, smooth pulling effort on both lateral sides of the supporting frames whereby the risk of dissociation between the refractory plates is avoided and whereby there is practically no limitation in moving range of the refractory plates, the refractory plates being easy to introduce and remove from the device and the device being easily mounted on and removed from the vessel.

DETAILED DESCRIPTION OF THE INVENTION

The slide gate device according to the invention for use on a pour vessel to control flow of molten metal through an outlet in the vessel shell comprises:

at least one refractory plate supporting frame, each supporting frame being linearly movable in a plane perpendicular to the axis of the outlet in the vessel shell and bearing at least one refractory insert plate having at least one aperture, whereby said supporting frame or frames are introducible into and removable from the slide gate device from one or both sides of the device without dismounting said device;

moving means for the refractory plate supporting frame or frames arranged on both lateral sides of said supporting frame or frames in the moving plane thereof, said moving means being interdependently coupled and adapted to cooperate with means provided to the supporting frame or frames so as to transmit an equally distributed, smooth pulling effort on each lateral side of said refractory plate supporting frame or frames;

a pushing system for urging said refractory plate supporting frame or frames, in the vicinity of the outlet in the vessel shell, towards said outlet, said pushing system comprising at least one lever acting on each side of the supporting frame, and force supplying means removed from the heat radiating area of said outlet, acting on said levers; whereby the refractory insert plates may be moved in very close cooperating contact with a perforated refractory outlet plate, pertaining to the device itself or to the vessel outlet, so as to control the flow of molten metal therethrough.

According to a particular feature of the invention, the whole slide gate device is assembled on a single frame or mounting plate, so that it is as a whole securable to or removable from the vessel shell.

In a first preferred embodiment of the invention the moving means for the refractory plate supporting frame or frames consist of two bolts arranged on both lateral sides of said supporting frame or frames and adapted to transmit motion thereto by screwing into threaded edges on both sides of said supporting frame or frames, and of two interdependently coupled driving means for said bolts, transmitting a rotary driving motion of equal magnitude to each of said bolts, so as to achieve a parallel driving motion on each side of said refractory plate supporting frame or frames.

In a second preferred embodiment of the invention the moving means for the refractory plate supporting frame or frames consist of two endless chains arranged on both lateral sides of said supporting frame or frames and adapted to transmit motion thereto by clutching over cogs provided on both sides of said supporting frame or frames, and of two interdependently coupled driving means for said endless chains, transmitting an equal driving motion to each of said chains, so as to achieve a parallel motion of the chains on each side of said refractory plate supporting frame or frames.

According to a particular feature of this latter embodiment of the invention, the slide gate device may further comprise guiding means provided on said frame or mounting plate of the device, cooperating with guiding means provided to the refractory plate supporting frame or frames, so as to linearly guide and support said supporting frame or frames in a plane perpendicular to the axis of the outlet in the vessel shell.

According to a further feature of the second embodiment of the invention, the interdependently coupled driving means for transmitting driving motion to the chains may, on the one hand consist of two sprocket wheels, two driving gear wheels secured to said sprocket wheels, two worm transmission gears of opposite pitch, mounted on one common axle and able to transmit driving motion to said driving gear wheels, and means for imparting a rotary movement to said worm transmission beams.

According to another further feature of said second embodiment, the interdependently coupled driving means for transmitting driving motion to the chains may on the other hand, consist of two sprocket wheels, two directly interconnected driving gear wheels secured to said sprocket wheels, and means for imparting a rotary movement to one of said directly interconnected driving gear wheels.

Preferably each endless chain of the slide gate device may thereby have a threefold construction, whereby the outer tracks of the triple chains are adapted to engage on the sprockets of double sprocket wheels of the driving means of the device, whereas the inner tracks of the triple chains are adapted to clutch over the cogs provided on the sides of the refractory plate supporting frame or frames.

According to still another feature of the second embodiment of the invention, the chains of the device are backed in the area where the chains are adapted to clutch over the cogs provided on both sides of the refractory plate supporting frame or frames so as to transmit driving motion to said supporting frame or frames, by guiding beams holding said chains in close contact with said cogs of the supporting frame or frames and with the lateral edges thereof.

Preferably also, the slide gate device according to the second embodiment of the invention comprises means for regulating and compensating the tension of the chains.

According to a particular feature of the first embodiment of the invention the interdependently coupled driving means for transmitting driving motion to the bolts consist of a worm, gear or chain transmission acting on the extremities of both bolts and means for imparting a rotary movement to said worm, gear or chain transmission.

Said transmission means acting on the extremities of the bolts may for instance consist of a system comprising worm gear reductors or chain reductors, imparting rotary movements of equal magnitude and opposite direction to each of said bolts, whereby the bolts and threaded edges at each side of the refractory plate supporting frame or frames have opposite pitches, or rotary movements of equal magnitude and direction, whereby the bolts and threaded edges at each side of the supporting frame or frames have parallel pitches.

According to a further preferred feature of the invention the levers of the pushing system urging the refractory plate supporting frame or frames in the vicinity of the outlet of the vessel shell, towards said outlet, each have their respective fulcrum located between the point where said lever urges said refractory plate supporting frame or frames and the point, removed from the heat radiating area of the vessel outlet, where the force supplying means act upon said lever.

The levers of the pushing system urging the refractory plate supporting frame or frames in the vicinity of the outlet in the vessel shell, towards said outlet, may in particular act on sliding rails or surfaces provided at each side of the supporting frame or frames.

Specifically and preferably the slide gate device according to the invention comprises at least three pushing levers acting at each side of the refractory plate supporting frame or frames.

The force supplying means of the pushing system may for instance be selected among springs, hydraulic or pneumatic jacks, counterweights, magnets and electromagnets.

According to another preferred feature of the invention the means for imparting a rotary movement to the transmission beams or driving gear wheels of the device according to the second embodiment of the invention, or to the worm, gear or chain transmissions of the device according to the first embodiment of the invention, may perform in both directions and/or at two or more different speeds.

Said means may thereby in particular consist of an electromotor.

In specific embodiments of the device according to the invention one refractory plate supporting frame bears one refractory plate; or one refractory plate supporting frame bears two or more refractory plates; or the device comprises at least two refractory plate supporting frames, whereby each frame may bear one or more refractory plates; each refractory plate may show one or more apertures of different shapes and/or cross sections.

EXAMPLES AND FIGURES OF SPECIFIC EMBODIMENTS

Other features and details of the invention will appear from the following detailed description, in which reference is made to the attached drawings which represent by way of purely illustrative examples a number of specific embodiments of the slide gate device according to the invention.

In these drawings.

In these various figures like reference characters are employed to designate the same parts.

EXAMPLE 1

Figure 1:
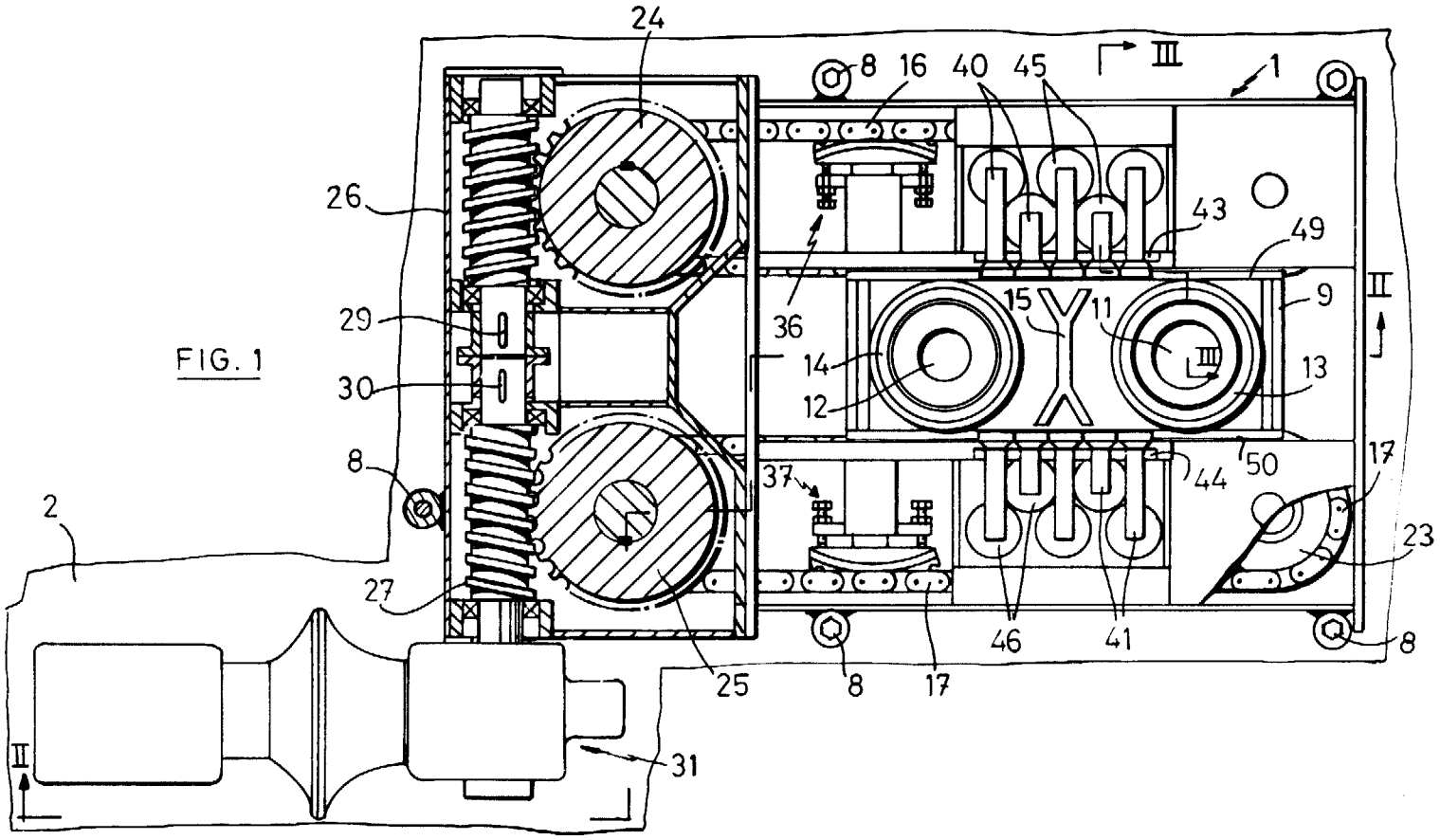
FIG. 1 is a bottom plan view, partially in section, of one embodiment of the slide gate device according to the invention.
Figure 2:
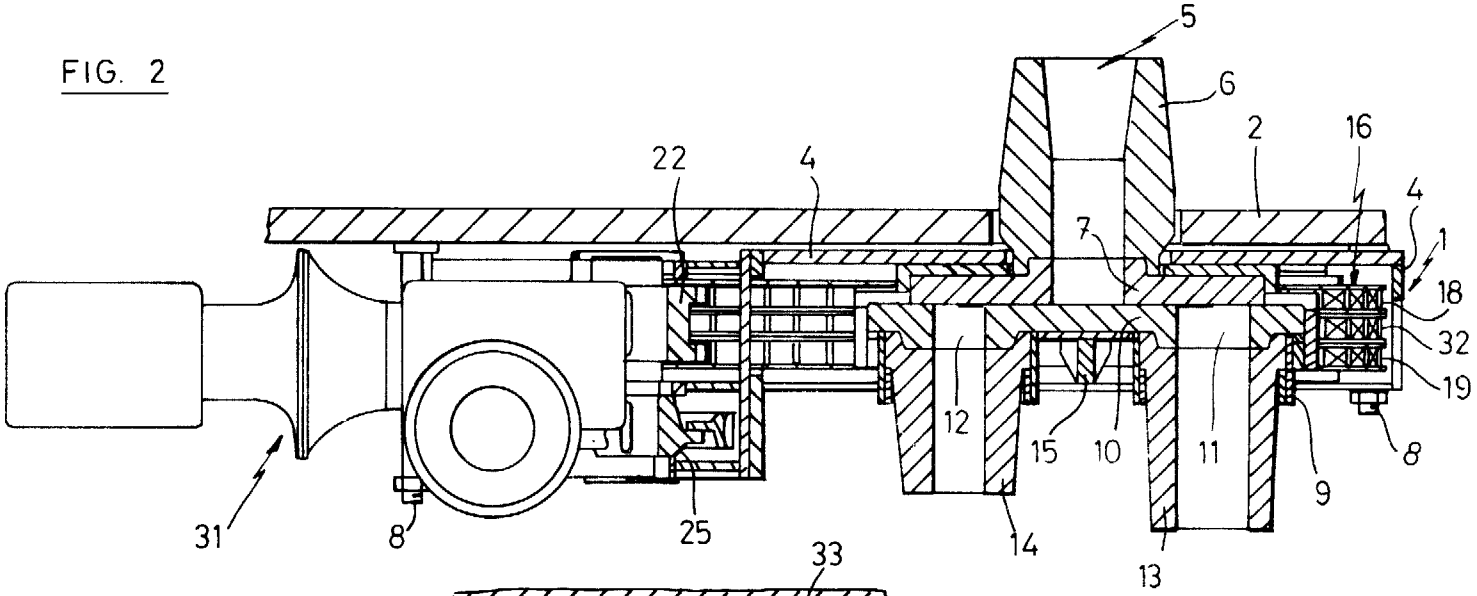
FIG. 2 is a side view of the device according to the plane II—II of FIG. 1.
Figure 4:
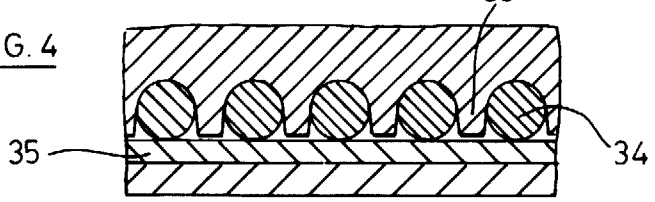
FIG. 4 is a section view of a detail of the device, according to the plane IV—IV of FIG. 3.

The slide gate device according to the invention, as shown in particular in FIGS. 1 to 4, designated, as a whole, by the reference character 1, is assembled on a single frame or mounting plate 4, fixed to the outer shell of a pour vessel for molten metal by means of five bolts designated by the reference 8.

This slide gate device 1 comprises a refractory outlet plate 7 (so-called upper plate) positioned in close cooperating contact with a refractory inner nozzle 6 of an outlet 5 in the pour vessel shell 2.

The slide gate device 1 further comprises a refractory plate supporting frame 9 bearing a refractory plate 10 having two apertures 11-12 of different sizes; said supporting frame 9 further supports two pouring tubes (or collector nozzles) 13-14, adapted to both apertures 11-12 of the refractory plate 10.

The supporting frame 9 for the refractory plate 10 and the collector nozzles 13-14 comprises a reinforcement structure 15, to improve the rigidity of said supporting frame.

The slide gate device 1 further comprises two endless chains 16-17, of threefold construction, arranged at both sides of the supporting frame 9.

The outer tracks 18-19 and 20-21 of said chains 6-17 engage on the double sprockets of two driving sprocket wheels (one driving sprocket wheel 22 shown in FIG. 2), and of two guiding sprocket wheels (one guiding sprocket wheel 23 indicated in FIG. 1) arranged at the extremities of the endless chain loops.

Two driving gear wheels 24–25 are secured to said driving sprocket wheels of the slide gate device shown in FIGS. 1 to 4, and two worm transmission gears 26–27 of opposite pitch, mounted on two interconnected shafts 29–30 forming one common axle for both worm transmission beams 26–27, transmit driving motion to said driving gear wheels 24–25 from an electromotor and reduction box designated as a whole by the reference character 31.

The inner tracks 32 of the chains 16–17 clutch over cogs 33, provided on the sides of the refractory plate supporting frame 9 to transmit movement to said frame.

In the area where the inner tracks 32 of the chains 16–17 clutch over the cogs 33 of the supporting frame 9, the chain link axles 34 of the inner tracks 32 of the chains 16–17 are backed by guiding beams or sliding guides 35 to hold said chains 16–17 in close contact with the cogs 33 of the supporting frame 9 and with the lateral edges of said supporting frame 9.

The suitable tension of the chains is furthermore regulated and/or compensated by means of known chain tension regulators 36–37.

The supporting frame 9 is further guided in its linear path in front of the vessel outlet 5, by the cooperating action of guiding rails 38 provided to the frame or mounting plate of the device and guiding rail runners 39 provided to the lateral edges of the supporting frame.

The slide gate device 1 according to the invention as shown in FIGS. 1 to 4 further comprises at each side of the supporting frame 9, five pushing levers 40–41 urging the supporting frame 9 towards the outlet 5 in the vessel shell.

Said pushing levers 40–41 are respectively hinged on coaxially extending spindles 42 engaged in spindle supports 43–44.

Figure 3:
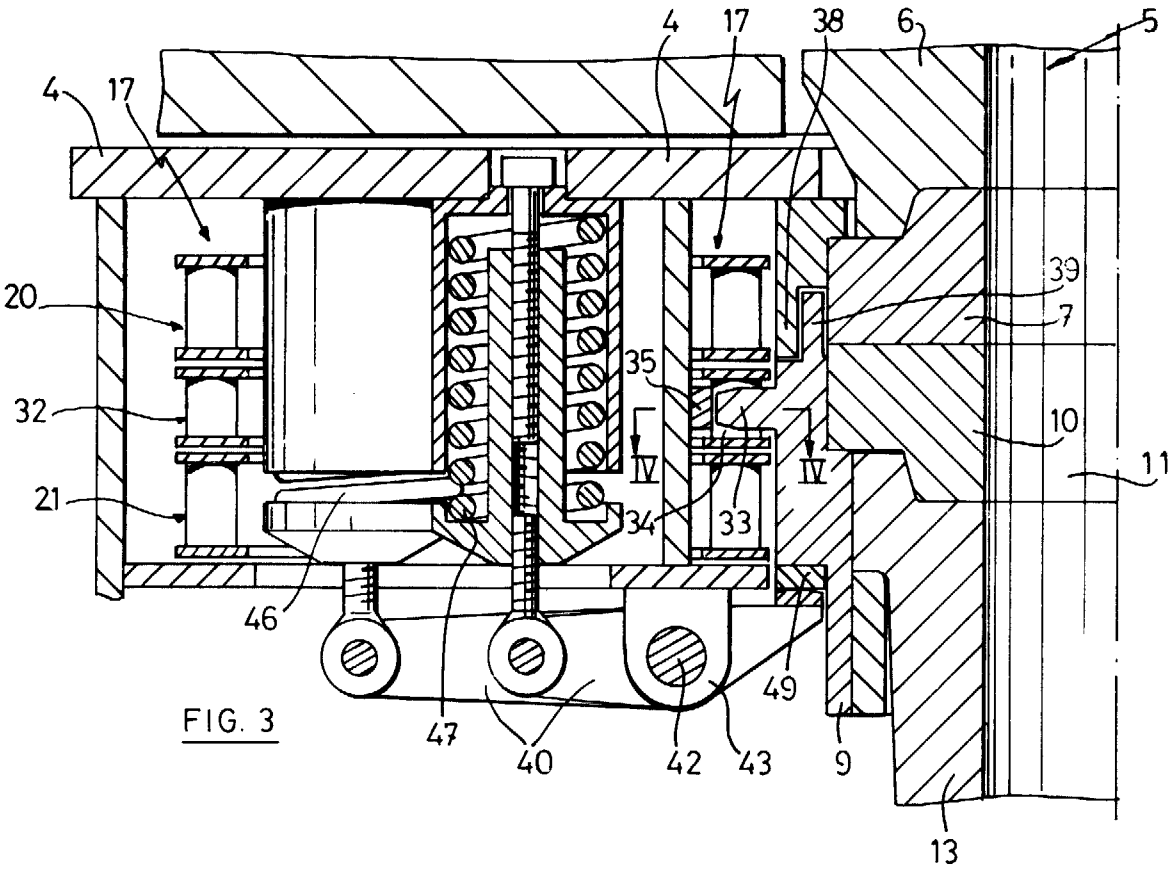
FIG. 3 is a section view according to the plane III—III of FIG. 1.

Each of said pushing levers 40–41 is provided with an independent force supplying means 45–46, such as in particular springs 47–48, as represented on FIG. 3, bearing against the frame or mounting plate 4 of the device, whereby each independent force supplying means 45–46 exerts a pushing force on the extremities of the respective pushing levers 40–41 remoted from the vessel outlet.

At their extremities near the vessel outlet the pushing levers 40–41 urge against sliding beams or rails 49–50 provided on the lateral edges of the supporting frame 9.

During the operation of the slide gate device according to FIGS. 1 to 4 the supporting frame 9 bearing the refractory plate 10 and the collector nozzles 13–14 may be moved linearly in front of the refractory plate 7 (upper plate), by actuating the electromotor 31, transmitting a driving motion to the chains 16–17, whereby the movement of the supporting frame 9 may perform in forward or backward direction, so as to bring the desired portion of the refractory plate 10 in front of the vessel outlet 5 and thus start the pouring of molten metal or modify or interrupt the flow thereof.

By providing suitable regulating means to the electromotor of the device it is further possible to operate the movement of the supporting frame 9 at different, variable speeds, so as to obtain a practically uniform regulation of the flow of molten metal through the vessel outlet 5 by uniformly modifying the coinciding portion of the aperture 11—12 in the refractory plate 9 and the aperture in the upper plate 7, by a kind of throttling effect.

Thanks to the pushing levers 40–41 the refractory plate 10 is thereby tightly pressed against the upper plate 7, during the operation of the slide gate device, as well as during the pouring of the molten metal; in this manner leakages of molten metal between said refractory plates are avoided.

Owing further to the limited cumbersomeness and open construction of the chain drive system of the slide gate device according to FIGS. 1 to 4, it is much more easy to change a collector nozzle on the supporting frame of the refractory plate, when such supporting frame is already in place for operation.

As furthermore the path of the supporting frame is unlimited at least at one side of the device, and has a considerable freeness at the other side of the device when using such chain drive system, it is very easy to remove the supporting frame from the device to quickly replace it by another frame bearing another refractory plate, when other aperture sizes are required or when a worn refractory plate has to be replaced.

It may further be observed that thanks to the compactness of the open construction achieved with the device according to the invention, as it is assembled on a single frame or mounting plate, it is easy to replace it as a whole in very little time by another, spare-device when any failure appears to some part of the device.

It is sufficient therefor to unscrew the five bolts 8, to remove the defective device and to rescrew the spare-device onto the vessel shell 2.

EXAMPLE 2

Figure 5:
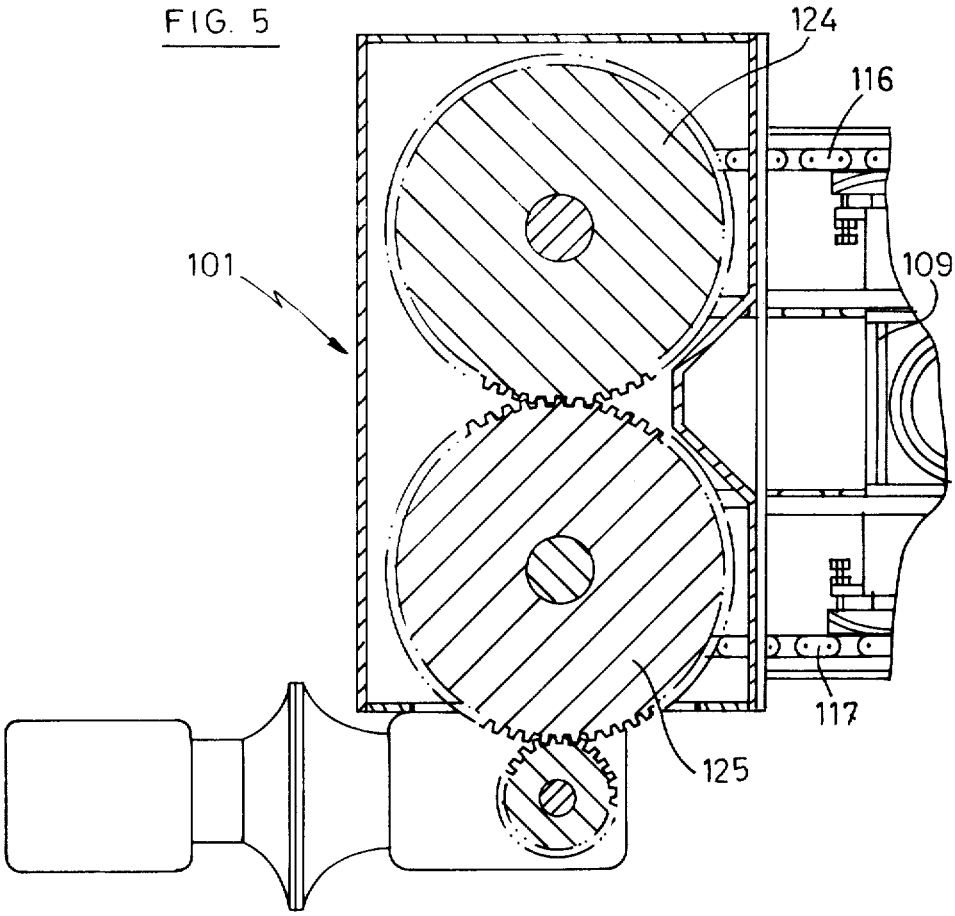
FIG. 5 is a partial bottom view in section of another embodiment of the slide gate device according to the invention.

The embodiment of the slide gate device according to the invention, shown in FIG. 5 and designated as a whole by the reference character 101, only differs from the embodiment shown in FIGS. 1 to 4 in that the interdependently coupled driving means for transmitting driving motion to the chains 116–117, consist of two directly interconnected driving gear wheels 124–125 secured to the (not represented) driving sprocket wheels of the device 101 and of a transmission gear 130, transmitting the driving power of an electromotor and reductor box 131 to the driving gear 125.

The movement of the supporting frame 109 of the device 101 of FIG. 5 performs in exactly the same manner as explained for the device 1 shown in FIGS. 1 to 4, whereby said supporting frame may be moved in both directions at different speeds by suitably operating the electromotor and reductor box 131.

EXAMPLE 3

Figure 6:
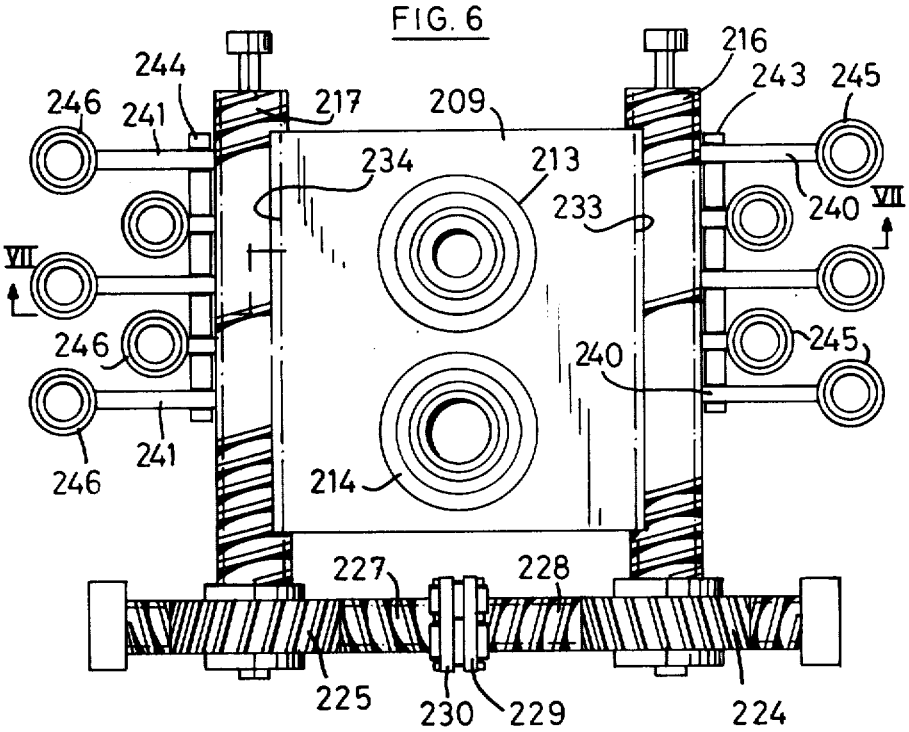
FIG. 6 is a top plan view of still another embodiment of the slide gate device according to the invention.
Figure 7:
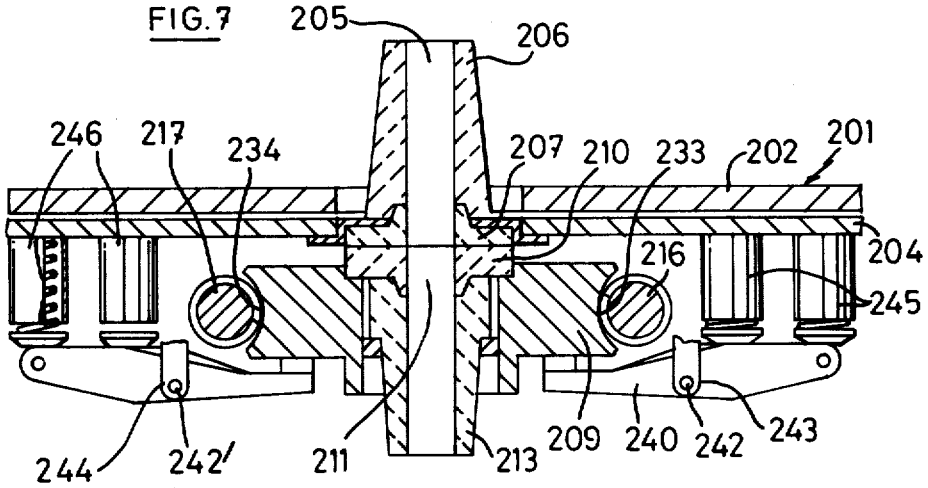
FIG. 7 is a section view according to plane VII—VII of FIG. 6.

The embodiment of the slide gate device according to the invention, shown in FIGS. 6 and 7 and designated as a whole by the reference character 201, uses screwing bolts 216–217 instead of endless chains 16–17 for performing the movement of a supporting frame 209.

The device 201 is thereby assembled on a single mounting frame 204, fixed to the vessel shell 202 by means of (not represented) bolts.

This device 201 comprises said refractory plate supporting frame 209 bearing a refractory plate 210, having apertures 211, and refractory pouring tubes 213–214 adapted to the apertures 211 of the refractory plate 210.

The refractory plate 210 may be moved in close cooperating contact with a refractory upper plate 207 which is itself positioned in close cooperating contact with a refractory inner nozzle 206 of the vessel outlet 205; therefore the device 201 further comprises two bolts 216–217 screwing into threaded edges 233–234 of the supporting frame 209, at the extremities of which bolts are provided worm reducing gears 224–225, to which the driving power of a (not represented) motor is transmitted by means of two worm transmission gears 227–228, mounted on two inter-connected shafts 229–230 so as to form one common axle for both worm transmission beams 227–228.

In the embodiment represented in FIGS. 6 and 7 the bolts 216–217 have parallel pitches, whereas the worm transmission beams 227 respectively 228 and the worm reducing gears 224 respectively 225 have opposite pitches.

Exactly the same operation of the device may of course be achieved when using bolts 216–217 having opposite pitches, whereby the worm transmission beams 227–228 and the worm reducing gears 224–225 have consequently adapted pitches.

Similar performance may of course also be obtained by replacing the worm gear reductors 227, 228–224, 225 by corresponding chain reductors.

The slide gate device 201 according to FIGS. 6 and 7 further comprises, at each side of the supporting frame 209 five pushing levers 240–241, urging the supporting frame 209 towards the outlet 205 in the vessel shell 202.

Said pushing levers 240–241 are respectively hinged on coaxially extending spindles 242, 242', engaged in spindle supports 243–244.

Each of said pushing levers 240–241 is provided with an independent force supplying means 245–246, such as in particular a spring as represented in FIG. 7, attached to the mounting frame 204 of the device 201.

As in the embodiment shown in FIGS. 1 to 4, described hereabove, each force supplying means 245–246 of the device 201 according to FIGS. 6 and 7 exerts a pushing force on the extremities of the respective pushing levers 240–241 remote from the vessel outlet.

At their extremities near the vessel outlet, the pushing levers 240–241 urge against the supporting frame 209 to hold the refractory plate 210 in close contact with the refractory upper plate 207.

The operation of this embodiment of the invention performs in a similar manner as that described in detail hereabove for the embodiment represented in FIGS. 1 to 4, and the same advantages are obtained with this embodiment represented in FIGS. 6 and 7.

Thus the refractory plate supporting frame 209 of the device 201 may be moved in close cooperating contact with the refractory upper plate 207 to start the pouring of molten metal or to modify, interrupt or regulate the flow thereof through the vessel outlet 205.

The bolt drive system of the slide gate device 201 according to FIGS. 6 and 7 thereby also provides an open construction with considerable freeness of movement of the supporting frame in both directions.

It must be clear that the invention is not limited to the embodiments and details disclosed hereabove, and that numerous modifications may be provided to said details without leaving the general outline of the invention.

It should thus for instance be evident that the device is not limited for use on a specific kind of pour vessel and may in particular be adapted to a pour laddle, a convertor, a tundish etc.

It must further be emphasized, that the system of the device is not limited to the use of only one supporting frame. It is for instance posssible to use several supporting frames whereby said frames may be introduced at one side of the device and removed therefrom at the other side.

It is further also possible to provide supporting frames bearing more than one refractory plate, whereby each refractory plate may have one or more pouring apertures.

Thus also, whereas the invention has been described specifically with reference to a device in which the means for providing a driving motion to the supporting frame comprise an electromotor, it must be clear that any system producing movement may be used.

In the same way, whereas the invention has been described specifically with reference to embodiments of the new device in which the moving means for the refractory plate supporting frame or frames comprise chains or bolts arranged along the lateral sides of the supporting frame or frames, it must be clear that any other interdependently coupled means adapted to transmit an equally distributed force to both lateral sides of the supporting frame or frames may be used; such other means may for instance also comprise two toothed racks, each attached at one extremity of both lateral sides of said supporting frame, and adapted to transmit a well distributed movement to said supporting frame from interdependently coupled driving means for said toothed racks.

The slide gate device according to this invention in fact allows a safe control of the flow of molten metal through an outlet in the shell of a pour vessel, whereby the refractory plate or plates are linearly movable in close self adjusting contact with the upper plate of the vessel outlet and are in the work position of said refractory plate(s) always urged by a constant and positive pressure towards the vessel outlet.

The force supplying means bringing about said constant positive pressure, which may in particular be selected from springs, hydraulic or pneumatic jacks, counterweights, magnets, electromagnets etc., are located out of the heat radiating area of the vessel outlet, thus avoiding or reducing the damages and wear of the force supplying means caused by the contact with hot elements and the exposure to heat radiation.

The various characteristic arrangements of the slide gate device according to the invention result in a number of interesting properties, which are a consequence of, or come in addition to the advantages and possibilities of the device already stated in the above description:

the device increases the safety of operation of the pouring vessels;

the device is easy to handle and to maintain due to its single frame construction;

the device allows choice of multiple apertures for controlling flow of molten metal;

the device allows reduced wear of its various parts, in particular of its refractory plates and of the force supplying means;

the device allows an easy replacement of refractory plates, possibly by continuous introduction and removal of supporting frames;

the device occupies but little space on the vessel shell owing to its compactness;

the device is very accessible in its various parts owing to its open construction.

What I claim is:

1. A slide gate device for use on a pour vessel to control the flow of molten metal through an outlet in the vessel shell, in which a refractory plate having an aperture is linearly movable in a plane which is perpendicular to the axis of the outlet in the vessel shell, whereby said aperture in said refractory plate may be brought in alignment with the outlet in the vessel shell, said device comprising;

at least one refractory plate supporting frame, each supporting frame being linearly movable in a plane perpendicular to the axis of the outlet in the vessel shell and bearing at least one refractory insert plate having at least one aperture, whereby said supporting frame is introduceable into and removable from the slide gate device from a side of the device without dismounting said device;

moving means for the refractory plate supporting frame arranged at both lateral sides of said supporting frame in the moving plane thereof, said moving means being interdependently coupled and adapted to transmit an equally distributed force to each lateral side of said refractory plate supporting frame;

a pushing system for urging said refractory plate supporting frame, in the vicinity of the outlet in the vessel shell, towards said outlet, said pushing system comprising levers acting on each side of the supporting frame, said outlet having a heat radiating area, and force supplying means removed from the heat radiating area of said outlet, acting on said levers;

whereby the refractory insert plates may be moved in very close cooperating contact with a perforated refractory outlet plate so as to control the flow of molten metal therethrough.

2. A slide gate mechanism according to claim 1, characterized in that said moving means for the refractory plate supporting frame are arranged along the length of both lateral sides of said supporting frame and are operably connected thereto, so as to transmit an equally distributed force along the length of each lateral side of said refractory plate supporting frame.

3. A slide gate device according to claim 2, characterized in that said moving means for the refractory plate supporting frame comprises two bolts arranged along both lateral sides of the supporting frame, threaded edges on both sides of said supporting frame for receiving a motive force from said bolts, and two interdependently coupled driving means for said bolts, transmitting a rotary driving motion of equal magnitude to each of said bolts, so as to achieve a parallel driving motion on each side of said refractory plate supporting frame.

4. A slide gate device according to claim 2, characterized in that said moving means for the refractory plate supporting frame comprises two endless chains arranged along both lateral sides of said supporting frame and adapted to transmit motion thereto, cogs provided on both sides of said supporting frame for receiving said motion, and two interdependently coupled driving means for said endless chains, so as to achieve a parallel motion of the chains on each side of said refractory plate supporting frame.

5. A slide gate device according to claim 1, characterized in that the device is assembled on a single mounting member, so that it is as a whole securable to, or removable from the vessel shell.

6. A slide gate device according to claim 5, characterized in that it further comprises guiding means provided on said mounting member of the device, cooperating with guiding means provided on the refractory plate supporting frame, so as to linearly guide and support said supporting frame in a plane perpendicular to the axis of the outlet of the vessel shell.

7. A slide gate device according to claim 1, characterized in that said moving means for one refractory plate supporting frame consist of two toothed racks, each attached at one extremity of both lateral sides of said supporting frame so as to transmit motion thereto, and of interdependently coupled driving means for said toothed racks, transmitting an equal driving motion to each of said racks, so as to achieve a parallel motion at each side of said refractory plate supporting frame.

8. A slide gate device according to claim 1, characterized in that the levers of the pushing system urging the refractory plate supporting frame in the vicinity of the outlet of the vessel shell, towards said outlet, each have their respective fulcrum located between the point where said lever urges said refractory plate supporting frame and the point, removed from the heat radiating area of the vessel outlet, where the force supplying means act upon said lever.

9. A slide gate device according to claim 1, characterized in that the levers of the pushing system urging the refractory plate supporting frame in the vicinity of the outlet in the vessel shell, towards said outlet, act on sliding surfaces provided at each side of the supporting frame.

10. A slide gate device according to claim 1, characterized in that the interdependently coupled moving means for the refractory plate supporting frame may perform in both directions at two or more different speeds.

* * * * *